US010527982B2

(12) United States Patent
Lindig

(10) Patent No.: US 10,527,982 B2
(45) Date of Patent: Jan. 7, 2020

(54) FUSER FAILURE PREDICTION

(71) Applicant: Hewlett-Packard Development Company, L.P., Houston, TX (US)

(72) Inventor: Darin Lindig, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/097,574

(22) PCT Filed: Jul. 22, 2016

(86) PCT No.: PCT/US2016/043506
§ 371 (c)(1),
(2) Date: Oct. 29, 2018

(87) PCT Pub. No.: WO2018/017115
PCT Pub. Date: Jan. 25, 2018

(65) Prior Publication Data
US 2019/0163101 A1 May 30, 2019

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/55* (2013.01)

(58) Field of Classification Search
CPC ..... G03G 15/2039; G03G 15/2053; G03G 15/55; G03G 15/553; G03G 2221/1663
See application file for complete search history.

(56) References Cited

U.S. PATENT DOCUMENTS

| | | | | |
|---|---|---|---|---|
| 4,873,549 | A | 10/1989 | Tada et al. | |
| 7,330,689 | B2 | 2/2008 | Tsueda et al. | |
| 8,989,608 | B2 | 3/2015 | Asano et al. | |
| 9,372,449 | B1 * | 6/2016 | Torimoto | G03G 15/55 |
| 2011/0142472 | A1 * | 6/2011 | Mitsuoka | G03G 15/2039 399/69 |
| 2011/0217056 | A1 * | 9/2011 | Yoshinaga | G03G 15/20 399/33 |
| 2012/0070172 | A1 * | 3/2012 | Ota | G03G 15/2064 399/67 |
| 2013/0094869 | A1 * | 4/2013 | Lee | G03G 15/2053 399/33 |
| 2014/0147150 | A1 | 5/2014 | Sato | |

(Continued)

FOREIGN PATENT DOCUMENTS

| | | | |
|---|---|---|---|
| JP | 10177326 | A2 | 6/1998 |
| JP | 2000137408 | A | 5/2000 |

(Continued)

*Primary Examiner* — Carla J Therrien
(74) *Attorney, Agent, or Firm* — HP Inc. Patent Department

(57) ABSTRACT

An example apparatus includes a fuser slip detection portion to detect slip of a fuser, a temperature measurement portion to measure a temperature of the fuser, and a processor. The processor is to receive indication of a partial failure condition from the fuser slip detection portion determine a predicted complete failure condition when the indication of the partial failure condition corresponds to a temperature of the fuser that is below a temperature threshold, and generate an alert indicative of the predicted complete failure condition.

14 Claims, 5 Drawing Sheets

(56) References Cited

U.S. PATENT DOCUMENTS

| | | | | |
|---|---|---|---|---|
| 2015/0253704 | A1* | 9/2015 | Hirose | G03G 15/2039 399/33 |
| 2017/0060051 | A1* | 3/2017 | Tamaki | G03G 15/553 |

FOREIGN PATENT DOCUMENTS

| | | | |
|---|---|---|---|
| JP | 2001203072 | A | 7/2001 |
| JP | 2002156866 | A | 5/2002 |
| JP | 2005338698 | A | 12/2005 |
| JP | 2011197138 | A | 10/2011 |

* cited by examiner

FUSER FAILURE PREDICTION

BACKGROUND

In various imaging devices, such as printers, an image-forming toner is appropriately placed on a print medium, such as paper, in one section of the imaging device. The print medium is then transported through another section where the toner is fused onto the print medium. In this section, heat may be applied to the toner via a roller to fuse the toner.

BRIEF DESCRIPTION OF THE DRAWINGS

For a more complete understanding of various examples, reference is now made to the following description taken in connection with the accompanying drawings in which.

DETAILED DESCRIPTION

Various examples described herein may provide for prediction of the failure of a fuser. As used herein, a fuser may include a fuse roller and/or a fuser sleeve provided around a core, for example. In various example, the fuser sleeve may rotate about the core. Fusers can fail due to loss of lubrication, which can inhibit the ability of the fuser to rotate freely against a pressure roller. Total failure of the fuser can result in paper jams or other issues. In various examples, the rotation of the fuser may be monitored for slipping of the fuser during the startup stage. When the fuser is being heated, and the temperature has not yet reached fully operating level, slipping of the fuser may be indicative of a reduced lubrication level. This can be predictive of a complete failure. Thus, in various examples, when sufficient slipping of the fuser is detected at a temperature below a predetermined threshold, an alert may be generated to indicate to the user that a complete failure is impending. Such an alert may include notification to the user to replace the fuser soon.

As described above, a print medium with an image-forming toner placed thereon may be transported through a fuser section where the toner is fused onto the print medium. In various examples, the fuser section includes a pair of opposing rollers between which the print medium is passed. The opposing rollers may include a pressure roller which may be driven, for example, via gears and a fuse roller (or fuser) which rotates freely against the pressure roller. In this regard, the fuser may be provided with lubrication to facilitate the free rotation, with loss of lubrication leading to failure.

Figure 1:
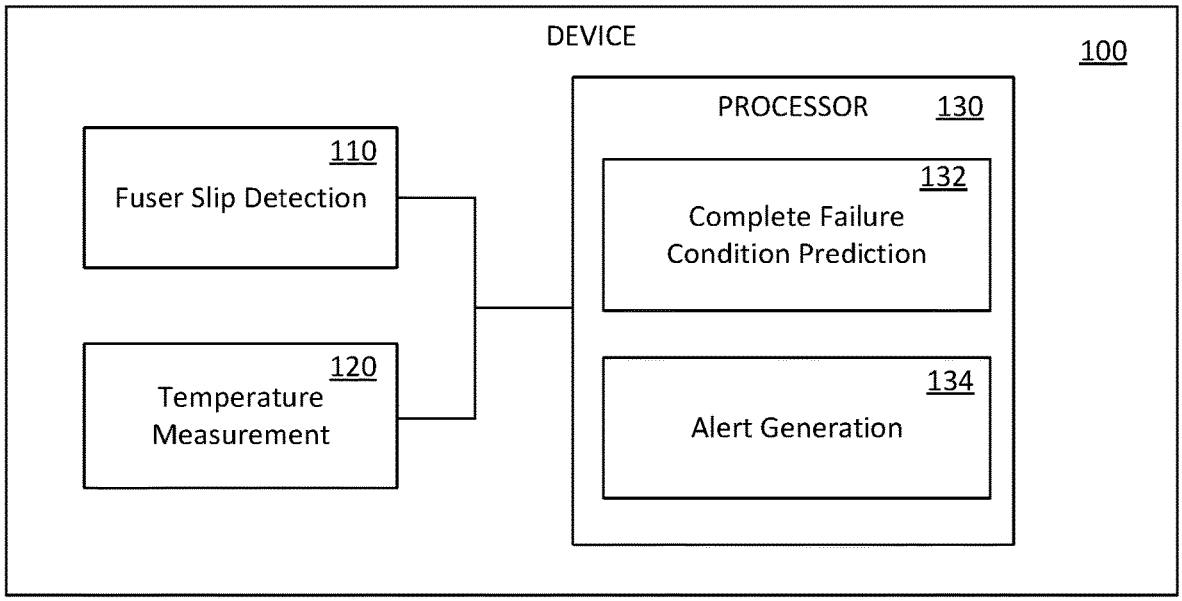
FIG. 1 is a schematic illustration of an example device for fuser failure prediction.

Referring now to the figures, FIG. 1 provides a schematic illustration of an example device 100 for fuser failure prediction. The example device 100 includes a fuser slip detection portion 110 and a temperature measurement portion 120. The fuser slip detection portion 110 may be coupled to a fuser and may monitor, for example, a rotational speed or rotational period of the fuser, as described in greater detail below with reference to FIG. 2. Similarly, the temperature measurement portion 120 may monitor the current temperature of the fuser.

The example device 100 further includes a processor 130 which may provide various functions of the device. For example, the processor 130 may control operation of the device. In various examples, the processor 130 and its functionality may be implemented as hardware, software or firmware, for example.

In the example illustrated in FIG. 1, the processor 130 of the example device 100 is coupled to the fuser slip detection portion 110 and the temperature measurement portion 120. In this regard, the processor 130 is in communication with and may receive data from the fuser slip detection portion 110 and the temperature measurement portion 120.

The processor 130 of the example device 100 includes a complete failure condition prediction portion 132 to predict an impending complete failure of the fuser to which the device 100 is coupled. The prediction of the impending complete failure of the fuser may be based on a partial failure condition determined based at least in part on input from the fuser slip detection portion 110. For example, when a partial failure condition may be determined if a detected slip is above a minimum slip threshold.

The complete failure condition prediction portion 132 may determine that a complete failure condition is predicted based on data received from the fuser slip detection portion 110 and the temperature measurement portion 120. In one example, the complete failure condition prediction portion 132 determines that a complete failure condition is predicted if the fuser slip detection portion 110 indicates that a slip was detected and if the temperature of the fuser, as indicated by the temperature measurement portion 120 is less than a predetermined temperature threshold.

In various examples, the magnitude of the detected slip may be a factor in predicting the complete failure condition. For example, a complete failure condition may be predicted if the magnitude of the detected slip is greater than a predetermined slip threshold.

The processor 130 of the example device 100 further includes an alert generation portion 134. The alert generation portion 134 may generate an alert that is indicative of the complete failure condition predicted by the complete failure condition prediction portion 132. The alert generated by the alert generation portion 134 may be in the form of an audio alarm or a visual indicator, for example.

Figure 2:
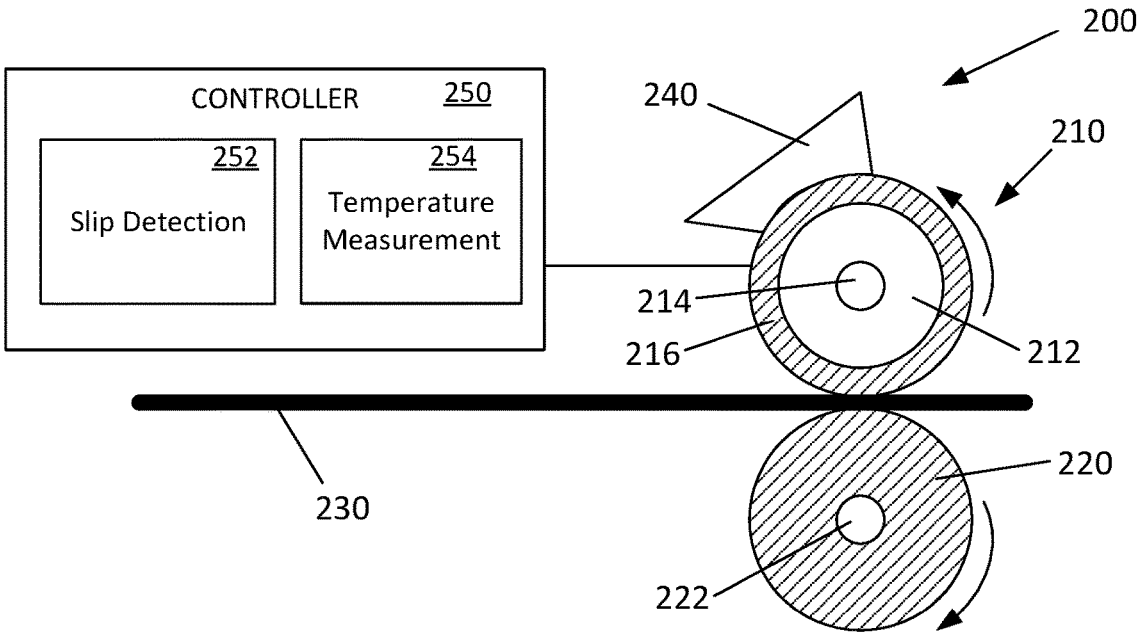
FIG. 2 is a side view of the example fuser portion with a fuser.

Referring now to FIG. 2, an example fuser portion 200 with a fuser is illustrated. The fuser portion 200 may be implemented in any of a variety of imaging devices such as printers, for example. The example fuser portion 200 is provided with a pair of rollers 210, 220 through which a print medium 230 may be passed.

In the example fuser portion 200 of FIG. 2, the pair of rollers includes a fuse roller 210 and a pressure roller 220. The fuse roller 210 includes a core 212 that may be formed of any of a variety of materials, such as aluminum, for example. The core 212 is positioned around a central axle 214 and is provided with a fuser sleeve 216 as an outer layer. In various examples, the fuser sleeve 216 is formed of rubber or other suitable material.

In various examples, the fuser sleeve 216 may be fixedly attached to the core 212. In this regard, the core 212 may be freely rotatable about the central axle 214. As used herein, freely rotatable may include unpowered or un-driven rotation. Freely rotatable may include the ability to rotate with minimal resistance. In this regard, the rotation may be facilitated with lubrication, for example.

In other examples, the core 212 may be fixedly attached to the central axis 214. In this regard, the fuser sleeve 216 may be allowed to freely rotate about the core 212. In various examples, the fuser sleeve 216 may be a thin film that may be provided with a layer of lubricant on the inside surface to facilitate rotation about the core 212.

The pressure roller 220 of the fuser portion 200 may be formed of any of a variety of materials, such as aluminum or rubber, for example. In various examples, the pressure roller 220 is rotatable about a central axle 222. In this regard, the pressure roller 220 may be driven by a motor through, for example a gearing system.

In operation, as the pressure roller 220 is driven, for example, by a motor, it causes a counter-rotation of the freely rotatable fuse roller 210. Thus, the pressure roller 220 and the fuse roller 210 rotate in opposite directions, as indicated by the arrows in FIG. 2. The rotation of the fuse roller 210 and the pressure roller 220 facilitates transportation of a print medium 230 (e.g., paper) therebetween.

The example fuser portion 200 of FIG. 2 is further provided with a heating system 240. The heating system 240 causes a temperature increase in at least the outermost portion of the fuse roller 210. In the example of FIG. 2, the heating system 240 causes heating of at least the fuser sleeve 216. Thus, as the heated fuser sleeve 216 rotates and facilitates transportation of the print medium 230, the heat from the fuser sleeve 216 may fuse any toner that may be provided on the surface of the print medium 230.

Various examples of the fuser portion 200 may include a variety of heating systems. For example, a heating system 240 may be provided to heat the fuse roller 210 from the outside, as shown in FIG. 2. Thus, heat is directly applied to the outermost surface of the fuse roller 210 (e.g., the fuser sleeve 216). In other examples, heat may be generated from within the fuse roller 210 through, for example the core 212 or the central axle 214. A variety of heating systems 240 are possible and are contemplated within the scope of the present disclosure.

The example fuser portion 200 of FIG. 2 is further provided with a controller 250. The controller 250 may be a processor that may control operation of the fuser portion 200. In various example, the controller 250 may be a controller of the imaging device containing the fuser portion 200. For example, the controller 250 may be a central processing unit (CPU) of the printer in which the example fuser portion 200 is provided.

Thus, the controller 250 may be provided to control various aspects of the fuser portion 200, including controlling the driving of the pressure roller 220, for example. In the illustrated example of FIG. 2, the controller 250 of the example fuser portion 200 is provided with a slip detection portion 252 and a temperature measurement portion 254. The slip detection portion 252 of FIG. 2 may be similar to the fuser slip detection portion 110 of FIG. 1 described above. In this regard, the slip detection portion 252 may monitor rotation of various portions of the example fuser portion 200. For example, the slip detection portion 252 may monitor a rotational speed or rotational period of the pressure roller 220 and/or the fuse roller 210. In one example, the slip detection portion 252 may detect slip by monitoring the rotational parameters of the fuser sleeve 216 relative to the rotational parameters of the core 212 or the pressure roller 220.

The temperature measurement portion 254 of FIG. 2 may be similar to the temperature measurement portion 120 of FIG. 1 described above. In this regard, the temperature measurement portion 254 of FIG. 2 may monitor the temperature of the fuser sleeve 216 as it rotates toward the print medium 230.

Figure 3:
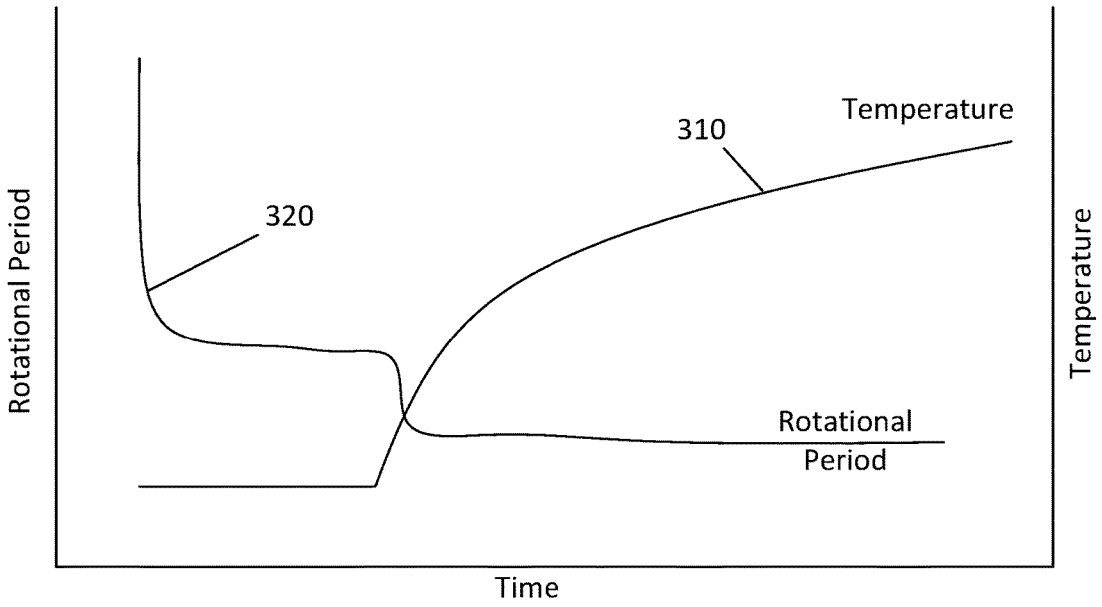
FIG. 3 illustrates profiles of fuser rotation and temperature for normal operation.
Figure 4:
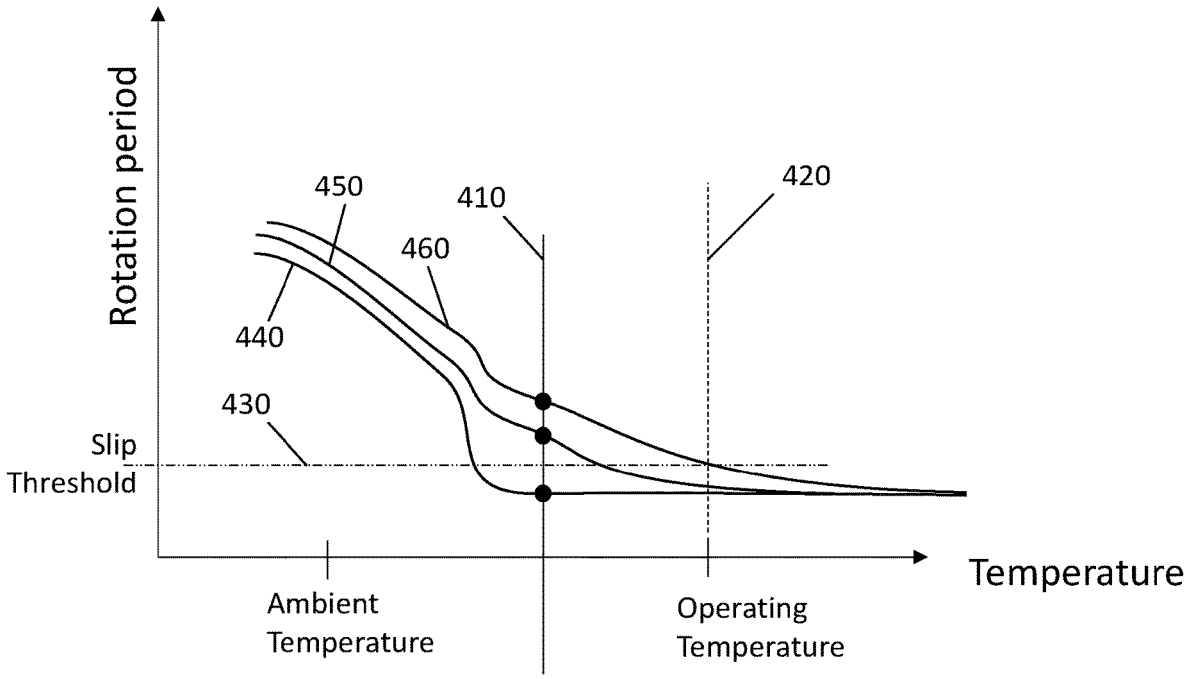
FIG. 4 illustrates an example profile of rotation period with increasing temperature.

Referring now to FIGS. 3 and 4, various profiles of rotation and temperature of an example fuser are illustrated. The profiles illustrated in FIGS. 3 and 4 illustrate different conditions of the fuser, as more clearly described below.

Referring first to FIG. 3, the various profiles illustrate a start-up phase of an example fuser and include a temperature profile 310 of the example fuser and a normal rotation profile 320. As the fuser is started, the rotation of the fuser (e.g., through the driven rotation of a pressure roller) is accompanied with the heating of the fuser. In the example described above with reference to FIG. 2, as the pressure roller 220 is driven, the freely rotating fuse roller 210 is rotated in the opposite direction. The heating system 240 causes heating of the fuser sleeve 216 from an ambient temperature to a full operating temperature. Thus, the temperature profile 310 illustrates an increase in the temperature of the fuser. In the illustrated example of FIG. 3, the temperature of the example fuser is shown at ambient temperature until heat is first applied, starting an increase in temperature toward an operating temperature.

The example of FIG. 3 further includes a normal rotation profile 320. In the illustrated example of FIG. 3, under normal operation conditions, the rotation of the fuser assembly begins before application of heat to the fuser. Thus, as indicated in the normal rotation profile 320, the rotation period decreases initially before the initial increase in the temperature. The rotation period before application of the heat corresponds to a rotation speed for a new fuser based on normal lubrication, for example. Due to the cold temperature at this point, some slip may still exist, resulting in a higher rotational period than for an operational rotational speed. The application of the heat corresponds to an increase in rotational speed, or a decrease in rotational period, as indicated by the rotation profile 320 of FIG. 3. The fuser then achieves an operational rotational speed.

The normal operating conditions illustrated by the normal rotation profile 320 in FIG. 3 may rely upon the freely rotating fuser. In various examples, such free rotation may be facilitated by a lubricant which may be provided within the fuser. In various examples, lubrication of the fuser may break down or become depleted over time. The breaking down or depletion of the lubricant may be exhibited when friction is greatest. In particular, this may occur when the fuser is cold and the lubricant may have higher viscosity. This may result in slipping of the fuser in early portions of the start-up phase. As the temperature increases, viscosity may decrease sufficiently for operation of the fuser. This condition may be referred to as a partial failure condition.

However, with increased usage, the breaking down or depletion of the lubricant may worsen. Thus, even with increasing temperature in later portions of the start-up phase or during full operational phase, the lubricant may not achieve sufficiently low viscosity, leading to complete failure of the fuser.

Under such conditions, a slip event may be detected by, for example, the slip detection portion 252 described above with reference to FIG. 2. In various examples, under partial-failure conditions, the rotation period before application of the heat may be greater than the rotation period during this phase for the normal rotation profile 320. The greater-than-normal rotation period may be detected as a slip event, for example.

The detection of the slip event (e.g., a partial failure) may be used to predict a complete failure of the fuser. In this regard, a complete failure may be predicted if the slip event occurs while the temperature of the fuser is below a predetermined threshold, as described in greater detail below with reference to FIG. 4. In various examples, the slip event may occur before the temperature reaches the temperature threshold, but may be resolved as heat is applied to the fuser. As the temperature of the fuser rises, the rotation of the fuser in the partial-failure case may reach a similar level to that of the normal operation case. Thus, in the example of the partial-failure case, a partial failure occurring before the temperature reaches a threshold temperature may be used to predict an impending complete failure and to notify the user to, for example, replace the fuser.

Referring now to FIG. 4, an example profile of rotation period with increasing temperature is illustrated for normal operation, a partial failure and a complete failure. In the example of FIG. 4, the rotation of the fuser may be monitored or measured at various points. For example, the rotation may be measured when the temperature reaches a threshold temperature 410 and when it reaches an operating temperature 420. Further, the rotation may be compared against a slip threshold 430 which may correspond to a magnitude of a detected slip. For example, the slip threshold 430 may correspond to a rotation period, as illustrated in FIG. 4.

Referring first to the normal operation profile 440 of FIG. 4, as the temperature increases from an ambient temperature, the rotation period decreases. In the example of FIG. 4, the rotation period for the normal operation profile 440 is below the slip threshold when the temperature reaches the threshold temperature 410. Accordingly, no alerts need to be generated.

Referring now to the partial failure profile 450 of FIG. 4, when the temperature reaches the temperature threshold 410, the rotation period is above the slip threshold 430, indicating a slip event. In various examples, the detection of a slip event that is greater than the slip threshold 430 when the temperature is at or below the temperature threshold 410 may cause an alert to be generated. As the temperature increases to the operating temperature 420, the rotation period of the partial failure profile 450 drops below the slip threshold 430.

Referring now the complete failure profile 460 of FIG. 4, when the temperature reaches the temperature threshold 410, the rotation period is above the slip threshold 430, indicating a slip event. As the temperature increases to the operating temperature 420, the rotation period of the partial failure profile 450 remains above the slip threshold 430. In various examples, the detection of a slip event that is greater than the slip threshold 430 when the temperature is at or above either the temperature threshold 410 or the operating temperature 420 may cause an alert to be generated indicating a complete failure of the fuser.

Figure 5:
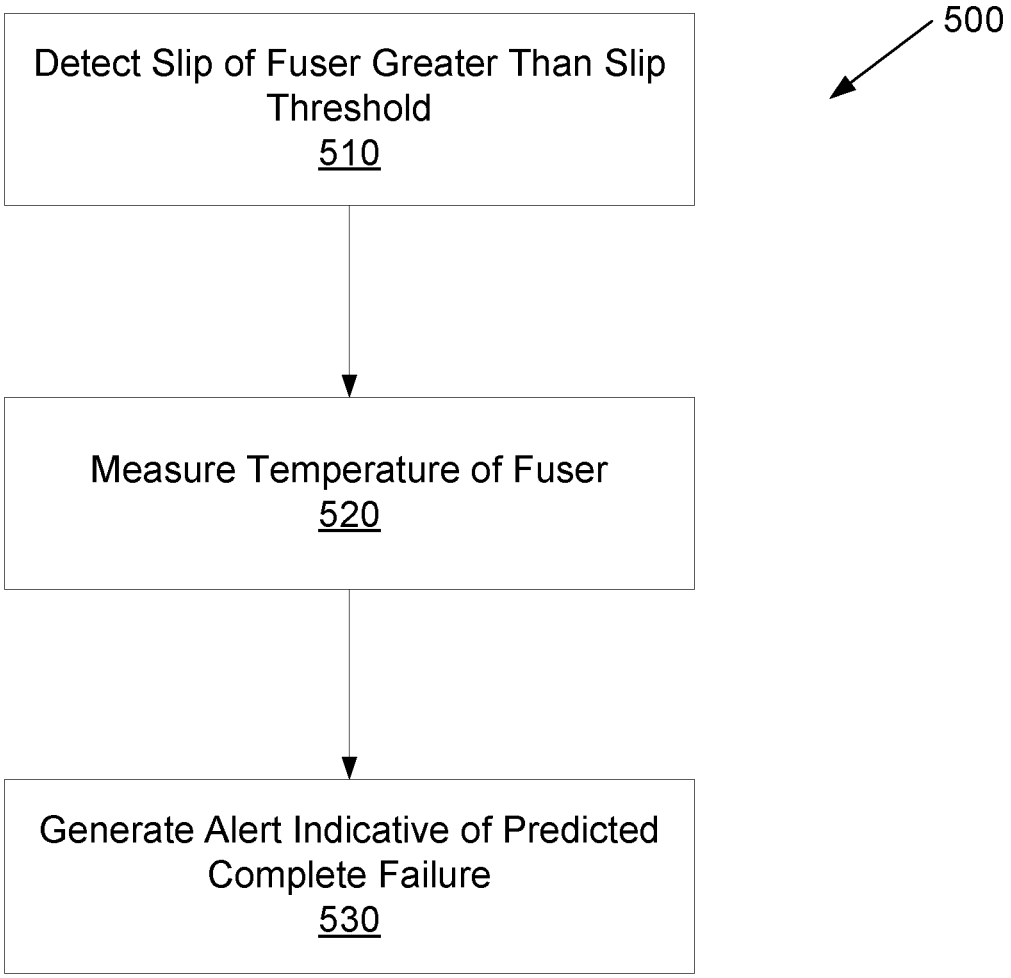
FIG. 5 is a flow chart illustrating an example process for fuser failure prediction.

Referring now to FIG. 5, a flow chart illustrates an example method for fuser failure prediction. The example method 500 may be implemented in various manners. For example, the example method 500 may be implemented as a process in the controller 250 of FIG. 2. The example method 500 begins with the detection of a slip (block 510) by, for example, the slip detection portion 252 of FIG. 2. As noted above, the magnitude of the detected slip may be a criteria in various examples. For example, in the example method of FIG. 5, the magnitude of the slip detected may be greater that a predetermined magnitude, or slip threshold.

The example method 500 further includes measuring of the temperature of the fuser at the time the slip was detected (block 520). In this regard, the temperature may be measured by the temperature measurement portion 254 of FIG. 2, as described above.

The example method 500 further includes generation of an alert that is indicative of a predicted complete failure (block 530). In various examples, the alert may be generated when the temperature of the fuser at the time of the detected slip is below a temperature threshold. For example, as described above with reference to FIG. 4, a complete failure condition may be predicted if a slip event occurs when the temperature is below the predetermined temperature threshold 410.

Figure 6:
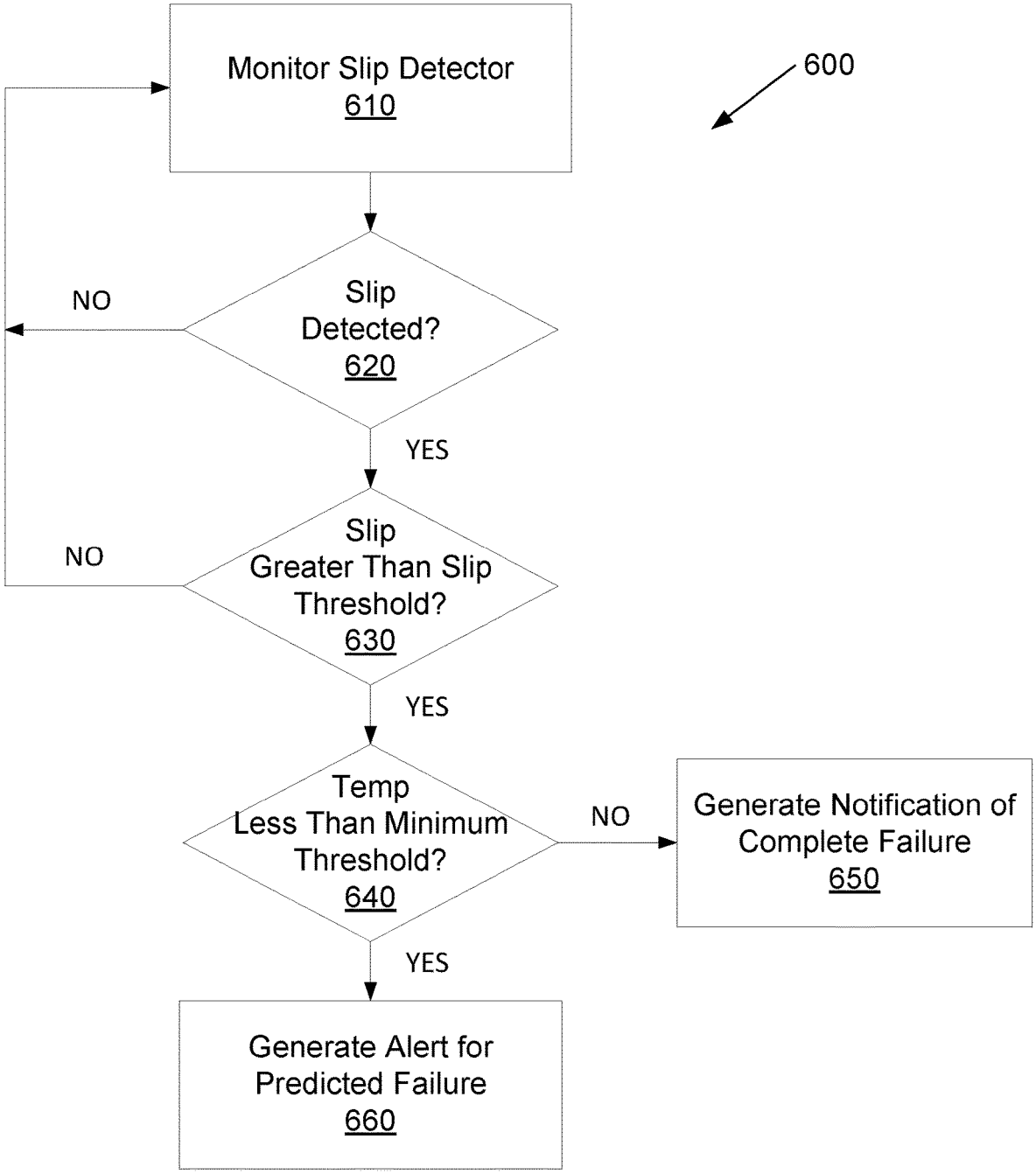
FIG. 6 is a flow chart illustrating another example process for fuser failure prediction.

Referring now to FIG. 6, a flow chart illustrates another example method for fuser failure prediction. Similar to the example method 500 of FIG. 5, the example method 600 of FIG. 6 may be implemented in a variety of manners, such as in the controller 250 of the example fuser portion 200 of FIG. 2.

The example method 600 includes monitoring of a slip detector (block 610). In this regard, a slip detector may be continuously or regularly monitored for an indication of a slip of the fuser (e.g., slip of the fuser sleeve). At block 620, a determination may be made as to whether a slip has been detected. Again, the determination may be made continuously or regularly. If no slip is detected, the method 600 returns to block 610 and continues to monitor the slip detector. On the other hand, if a slip is determined to have been detected at block 620, the example method 600 proceeds to block 630.

At block 630, the magnitude of the detected slip may be compared to a predetermined slip threshold. If the magnitude of the detected slip is not greater than the predetermined slip threshold, the method returns to block 610 and continues to monitor the slip detector. On the other hand, if the magnitude of the detected slip is greater than the predetermined slip threshold, the method proceeds to block 640.

At block 640, the temperature of the fuser at the time of the detected slip is compared against a predetermined temperature threshold. If the temperature of the fuser at the time of the detected slip is not less than the predetermined temperature threshold, a complete failure condition may be determined to exist, similar to the example complete failure profile 460 described above with reference to FIG. 4. In this regard, a notification of a complete failure, or of an imminent complete failure, may be generated. Such notification may alert the user to immediately replace the fuser. In various examples the alert may be a visual alert, such as an LED warning light or a warning displayed on an LCD screen. In other example, the alert may be an audio alert, such as a repeating beep or the playback of a recorded alert.

If, at block 640, the temperature of the fuser at the time of the detected slip is less than the predetermined temperature threshold, a complete failure condition may be predicted, similar to the example partial failure profile 450 described above with reference to FIG. 4. In this regard, a notification of a predicted complete failure, or of an impending complete failure, may be generated.

Figure 7:
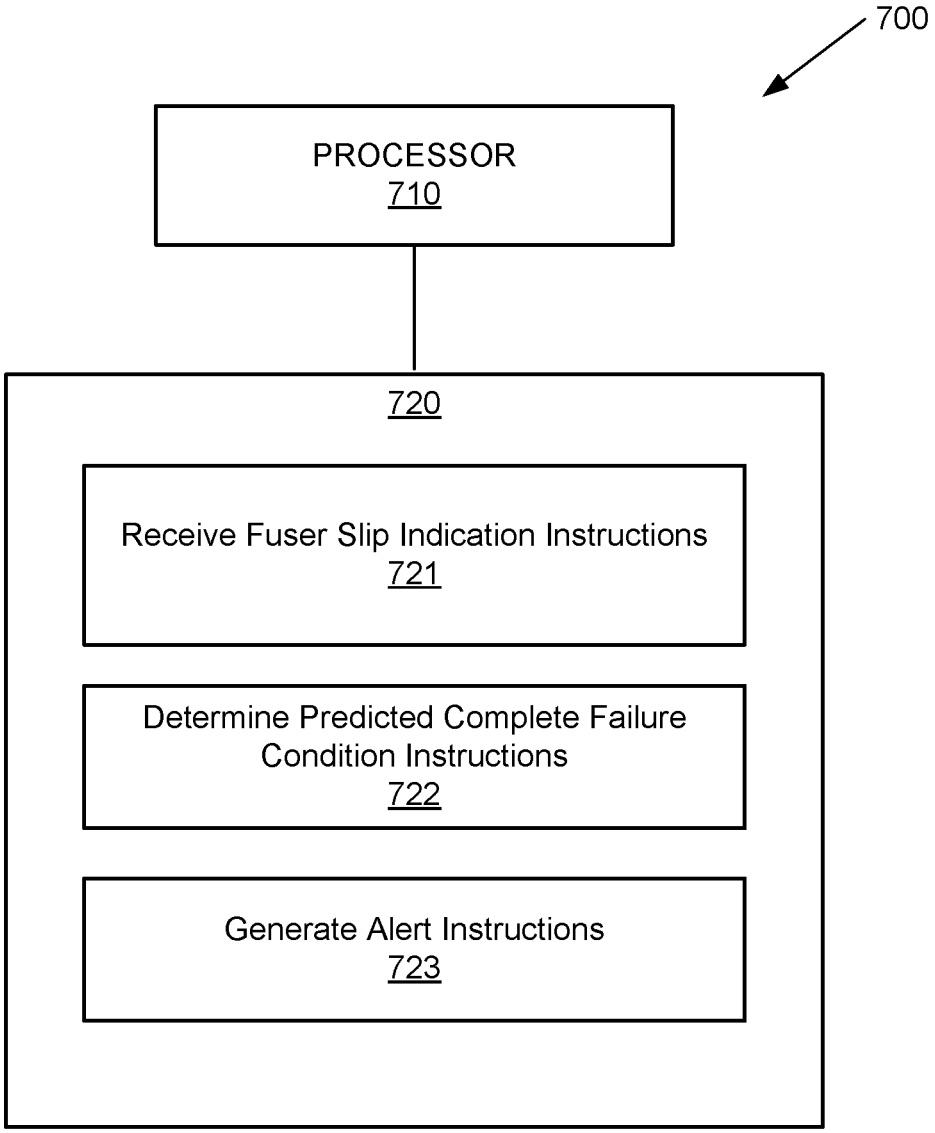
FIG. 7 illustrates a block diagram of an example system with a computer-readable storage medium including instructions executable by a processor for fuser failure prediction.

Referring now to FIG. 7, a block diagram of an example system is illustrated with a non-transitory computer-readable storage medium including instructions executable by a processor for fuser failure prediction. The system 700 includes a processor 710 and a non-transitory computer-readable storage medium 720. The computer-readable storage medium 720 includes example instructions 721-723 executable by the processor 710 to perform various functionalities described herein. In various examples, the non-transitory computer-readable storage medium 720 may be any of a variety of storage devices including, but not limited to, a random access memory (RAM) a dynamic RAM (DRAM), static RAM (SRAM), flash memory, read-only memory (ROM), programmable ROM (PROM), electrically erasable PROM (EEPROM), or the like. In various examples, the processor 810 may be a general purpose processor, special purpose logic, or the like.

The example instructions include receive fuser slip indication instructions 721. For example, as described above with reference to FIG. 1, a device 100 may be provided with a processor 130 which receives indications of fuser slip from a fuser slip detection portion 110.

Referring again to FIG. 7, the example instructions further include determine predicted complete failure condition instructions 722. As described with reference to the various examples above, a predicted complete failure condition may be determined when the fuser slip indication corresponds to a fuser temperature that is below a temperature threshold. For example, as indicated in the example of FIG. 4, a complete failure condition may be predicted when a slip event occurs at a temperature that is below the predetermined temperature threshold 410.

The example instructions of FIG. 7 further include generate alert instructions 723. In this regard, an alert may be generated that is indicative of the predicted complete failure condition. As described above, in various examples, the generated alert may be an audio alert or a visual alert.

Thus, in accordance with various examples described herein, a partial failure may be used as an early indicator of a predicted complete failure. The detection of a partial failure may be used to generate an alert to the user to replace the fuser before the complete failure occurs.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described in order to explain the principles and the nature of various examples of the present disclosure and its practical application to enable one skilled in the art to utilize the present disclosure in various examples and with various modifications as are suited to the particular use contemplated. The features of the examples described herein may be combined in all possible combinations of methods, apparatus, modules, systems, and computer program products.

It is also noted herein that while the above describes examples, these descriptions should not be viewed in a limiting sense. Rather, there are several variations and modifications which may be made without departing from the scope as defined in the appended claims.

What is claimed is:

1. A device, comprising:

a fuser slip detection portion to detect slip of a fuser;

a temperature measurement portion to measure a temperature of the fuser; and a processor to:

receive indication of a partial failure condition from the fuser slip detection portion;

determine a predicted complete failure condition when the indication of the partial failure condition corresponds to a temperature of the fuser that is below a temperature threshold; and generate an alert indicative of the predicted complete failure condition.

2. The device of claim 1, wherein the fuser slip detector is to measure a rotational period of the fuser.

3. The device of claim 2, wherein the fuser slip detector is to detect a slip of the fuser when the fuser slip detector measures an increase in the rotational period.

4. The device of claim 1, wherein the fuser is a fuser sleeve to rotate freely around an axle and against a pressure roller.

5. The device of claim 4, wherein the fuse slip detector is to detect a slip of the fuser when the fuser slip detector measures either an increase in the rotational period of the fuser or a decrease in the relative rotational speed between the fuser sleeve and the axle.

6. The device of claim 1, wherein the processor is further to:

determine a complete failure condition when the detected slip is above the slip threshold and above the temperature threshold; and generate a failure alert indicative of the complete failure condition.

7. A method, comprising:

detecting a slip of a fuser greater than a slip threshold;

measuring a temperature of the fuser;

generating an alert indicative of a predicted complete failure condition when the temperature of the fuser is below a temperature threshold;

determining a complete failure condition when the detected slip occurs when the temperature is above the temperature threshold; and generating a failure alert indicative of the complete failure condition.

8. The method of claim 7, wherein detecting the slip of the fuser includes measuring a rotational period of the fuser.

9. The method of claim 8, wherein detecting the slip of the fuser further includes measuring an increase in the rotational period.

10. The method of claim 7, wherein the fuser is a fuser sleeve to rotate freely around an axle and against a pressure roller.

11. The method of claim 10, wherein detecting the slip of the fuser includes measuring either an increase in the rotational period of the fuser or a decrease in the relative rotational speed between the fuser sleeve and the axle.

12. A non-transitory computer-readable storage medium encoded with instructions executable by a processor of a computing system, the computer-readable storage medium comprising instructions to:

receive a fuser slip indication;

determine a predicted complete failure condition when the fuser slip indication corresponds to a fuser temperature that is below a temperature threshold; and generate an alert indicative of the predicted complete failure condition.

13. The non-transitory computer-readable storage medium of claim 12, further comprising instructions to:

determine a complete failure condition when the fuser slip indication corresponds to a fuser temperature that is above the temperature threshold; and generate a failure alert indicative of the complete failure condition.

14. The non-transitory computer-readable storage medium of claim 12, wherein the fuser slip indication is indicative of a slip of the fuser greater than a predetermined slip threshold.

* * * * *